US006779628B2

(12) United States Patent
Fuhrmann et al.

(10) Patent No.: US 6,779,628 B2
(45) Date of Patent: Aug. 24, 2004

(54) DEVICE FOR PRODUCING AN OVERTONE-RICH SPORTY EXHAUST SOUND

(75) Inventors: Bernd Fuhrmann, Edenkoben (DE); Friedrich Bielert, Göttingen (DE)

(73) Assignee: Heinrich Gillet GmbH, Edenkoben (DE)

( * ) Notice: Subject to any disclaimer, the term of this patent is extended or adjusted under 35 U.S.C. 154(b) by 0 days.

(21) Appl. No.: 10/328,692

(22) Filed: Dec. 24, 2002

(65) Prior Publication Data

US 2003/0089550 A1 May 15, 2003

Related U.S. Application Data

(63) Continuation of application No. 09/764,917, filed on Jan. 18, 2001, now abandoned.

(51) Int. Cl.[7] ..... F01N 7/10

(52) U.S. Cl. ..... 181/240; 181/238; 60/313; 60/323

(58) Field of Search ..... 60/323, 236, 212, 60/313, 314, 322, 324; 181/240, 238

(56) References Cited

U.S. PATENT DOCUMENTS 4,197,704 A * 4/1980 Date et al. ..... 60/322
4,373,329 A * 2/1983 Martini ..... 60/305
4,731,995 A * 3/1988 McFarland, Jr. ..... 60/313
6,155,046 A * 12/2000 Kato et al. ..... 60/323

* cited by examiner

*Primary Examiner*—Marlon T. Fletcher
*Assistant Examiner*—David S. Warren
(74) *Attorney, Agent, or Firm*—Friedrich Kueffner

(57) ABSTRACT

The device for producing an overtone-rich, sporty exhaust sound of the exhaust system of a four-cylinder engine includes exhaust pipes with four manifold pipes, at least one front pipe and a tail pipe. The length and/or cross-section of at least one exhaust pipe differ from the length and/or cross-section of the other exhaust pipes. At least some of the exhaust pipes lead into a first, second and/or third collecting point.

8 Claims, 3 Drawing Sheets

DEVICE FOR PRODUCING AN OVERTONE-RICH SPORTY EXHAUST SOUND

This application is a continuation of Ser. No. 09/764,917 filed on Jul. 18, 2001 now abandoned.

BACKGROUND OF THE INVENTION

1. Field of the Invention

The present invention relates to a device for producing an overtone-rich, sporty exhaust sound in four-cylinder engines.

2. Description of the Related Art

It is known in the art that motor vehicles equipped with six-cylinder, eight-cylinder or twelve-cylinder engines produce an exhaust sound which is considered particularly sporty by the customer. It is also known that motor vehicles equipped with four-cylinder engines do not produce such a sporty exhaust sound. Since it is not possible for reasons of cost and other reasons that each motor vehicle is equipped with a six-cylinder, eight-cylinder or twelve-cylinder engine, many attempts have been made to change the exhaust system of motor vehicles with four-cylinder engines in such a way that they produce a sportier sound. However, most of these measures only increase the amplitude of the sound at the outlet opening of the exhaust system at small rates of rotation and particularly during idle operation by acoustically switching off portions of the exhaust muffler. The exhaust sound becomes louder as a result of these measures, however, the known and popular exhaust sound of six-cylinder, eight-cylinder and twelve-cylinder engines is still not achieved.

When the exhaust sound of four-cylinder engines is analyzed, it is found that it contains the second, fourth, sixth, eighth, etc., harmonic of the basic frequency determined by the rate of rotation of the engine. When analyzing the exhaust sound of six-cylinder, eight-cylinder and twelve-cylinder engines in a similar manner, it can be found that it also contains the first, third, fifth, seventh, etc. harmonic and, depending on the type of engine, also the 1.5th, 2.5th, 3.5th, etc., harmonic of the basic frequency. These harmonics produced by the higher number of cylinders are completely lacking in the four-cylinder engine.

SUMMARY OF THE INVENTION

Therefore, it is the primary object of the present invention to provide a device which makes it possible also in four-cylinder engines to produce an overtone-rich, so-called sporty exhaust sound without increasing the amplitude of the exhaust sound.

In accordance with the present invention, in an exhaust system of a four-cylinder engine essentially composed of exhaust gas-conducting pipes with at least four manifold pipes, at least one front pipe and a tail pipe, the above object is met by selecting the length and/or cross-section of at least one of the exhaust pipes different from the length and/or cross-section of the other exhaust pipes, wherein at least some of the exhaust pipes lead into a first, second and/or third collecting point.

The present invention is based on the principle of delaying the sound events produced in the four cylinders of the engine at different times by providing different lengths and cross-sections of the exhaust gas-conducting pipes, so that superpositions occur at the collecting points of the pipes which correspond to a pulse pattern as it is known from six-cylinder, eight-cylinder or twelve-cylinder engines and, therefore, also contain the first, third, fifth, seventh, etc. harmonic and possibly the 1.5th, 2.5th, 3.5th, etc., harmonic of the basic frequency. It has been found in this connection that the exhaust sound subjectively even becomes quieter because the sound energy previously only contained in the second, fourth, sixth, etc., harmonic is transferred into the newly produced harmonics. In addition, the transformation is achieved equally well in the entire frequency range, as compared to previous solutions in which it was attempted to couple the lacking harmonics into the exhaust system by means of loudspeakers.

In accordance with a first embodiment of the invention, the length and/or cross-section of at least one manifold pipe deviate from the length and/or cross-section of the other manifold pipes. This makes it possible to produce the 1.5th, 2.5th, 3.5th, etc., harmonics.

In accordance with another embodiment of the invention, two front pipes are provided wherein the length and/or cross-section of one front pipe differ from the length and/or cross-section of the other front pipe. This makes it possible to produce the third, fifth, seventh, etc., harmonics of the basic frequency.

In accordance with a modification of the invention, at least two manifold pipes lead into the first collecting point where a front pipe begins. The two other manifold pipes can be combined at a second collecting point, as is the case in conventional four-cylinder engines.

However, it is also possible to combine three manifold pipes in a collecting point, wherein the front pipe following this collecting point is combined downstream with the fourth manifold pipe in a second collecting point.

In accordance with another embodiment of the invention, two collecting pipes are provided which lead into the third collecting pipe, wherein the length and/or cross-section of one of the collecting pipes deviate from the length and/or cross-section of the other collecting pipe.

Other possible measures for producing overtones are to couple a resonator space to at least one manifold pipe and/or collecting pipe, or to mount a screen, a nozzle, a valve and/or a catalyst body into at least one manifold pipe and/or collecting pipe.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
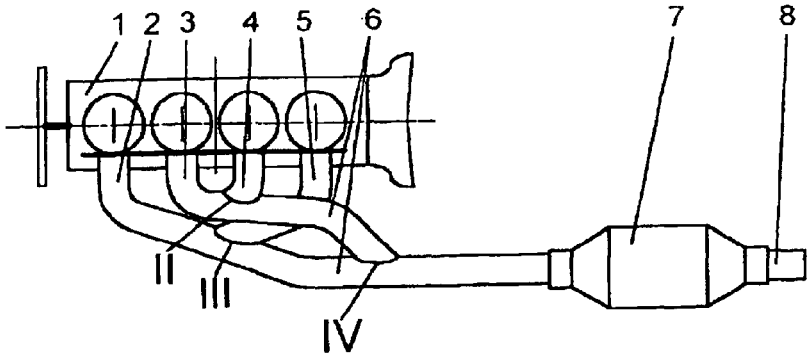
Fig.1 Prior Art
FIG. 1 is a schematic view of a four-cylinder engine with an exhaust system according to the prior art.

FIG. 1 of the drawing shows a four-cylinder internal combustion engine 1 and an exhaust system according to the prior art connected to the engine. The exhaust system includes four manifold pipes 2, 3, 4, 5 which meet in pairs in the first collecting points II and III, respectively. Two front pipes 6 lead from these collecting points to a third collecting point IV. Connected downstream of the collecting point IV are an exhaust muffler 7 and a tail pipe 8.

Figure 2:
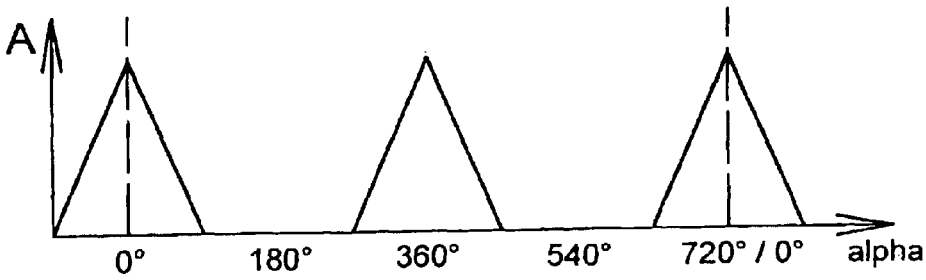
FIG. 2 is a simplified pulse diagram of the first collecting point II in FIG. 1.

FIG. 2 shows the simplified pulse diagram at the collecting point II. Blotted in the diagram is the amplitude A of the pulses produced in the cylinders 2 and 3 over the crank shaft angle $\alpha$.

Figure 3:
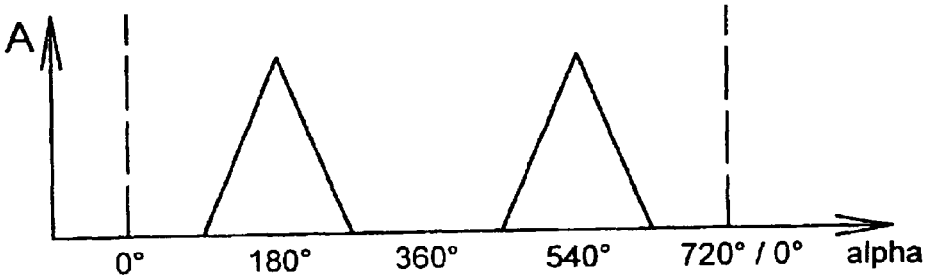
FIG. 3 is the simplified pulse diagram at the second collecting point III in FIG. 1.

FIG. 3 shows in a similar diagram the pulses produced by the cylinders 1 and 4 at the collecting point III.

Figure 4:
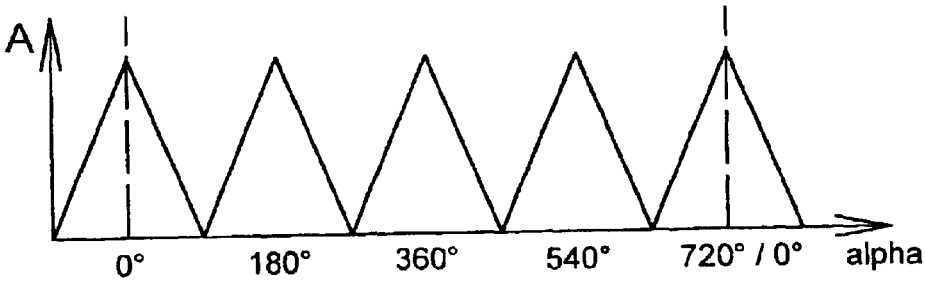
FIG. 4 is the simplified pulse diagram at the third collecting point IV in FIG. 1.

FIG. 4 shows the pulse diagram at the collecting point IV at the end of the two front pipes 6 resulting from the pulse diagrams of FIGS. 2 and 3.

Figure 5:
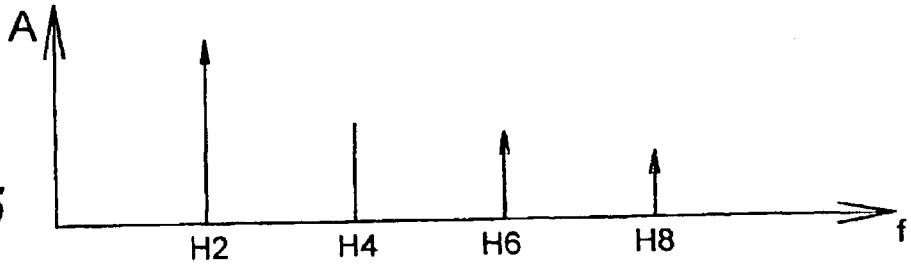
FIG. 5 shows the frequency spectrum corresponding to the pulse diagram of FIG. 4.

FIG. 5 shows the frequency spectrum corresponding to the pulse diagram of FIG. 4. Shown are the second, fourth, sixth, eighth, etc., harmonic H2, H4, H6, H8 belonging to the basic frequency predetermined by the engine speed, wherein the amplitude of the harmonics H2, H4, H4, H8 decreases continuously. Since the third, fifth, seventh, etc., harmonics as well as the 1.5th, 2.5th, 3.5th, etc., harmonics are missing, the "unsporty" exhaust noise typical for four-cylinder engines is produced at the tailpipe 8 of the exhaust system of FIG. 1.

Figure 6:
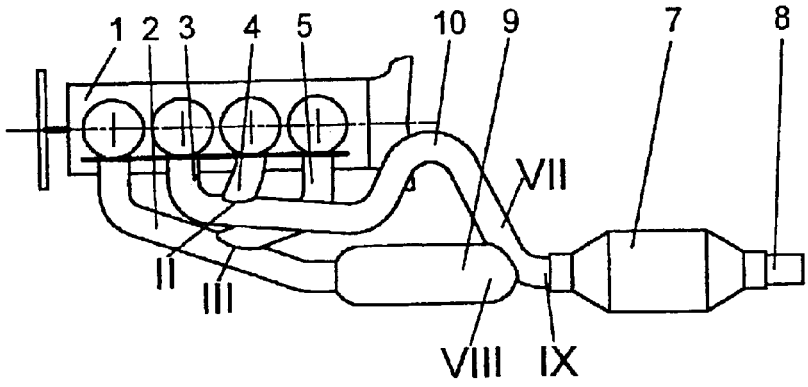
FIG. 6 is a schematic illustration of a four-cylinder engine with an exhaust system according to the present invention.

FIG. 6 shows the same four-cylinder engine 1, except that it is provided with an exhaust system changed in accordance with the present invention. In the illustrated embodiment, the four manifold pipes 2, 3, 4, 5 are the same and also meet in collecting points II and III, respectively. However, the front pipes 9, 10 connected downstream of these connecting points differ from each other with respect to length as well as cross-section. Consequently, the pulses produced by the cylinders 2, 3 and 1, 4 travel with different speeds through the front pipes 9, 10; this results in a completely different pulse diagram at the collecting point IX.

Figure 7:
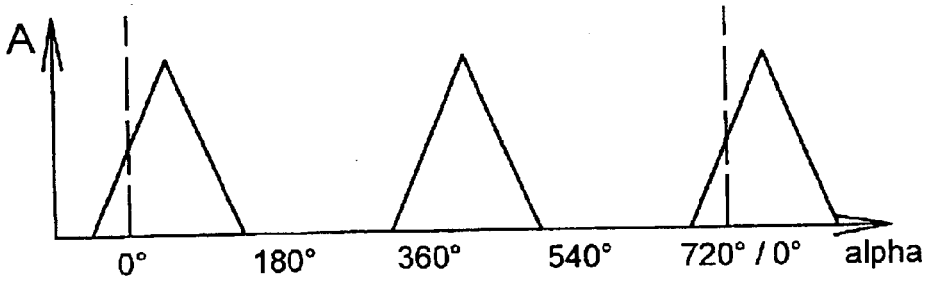
FIG. 7 is the pulse diagram at the first collecting point VII of FIG. 6.

FIG. 7 shows the pulse diagram at the location VII in front of the collecting point IX. This pulse diagram corresponds to the pulse diagram of FIG. 2, but with a time delay.

Figure 8:
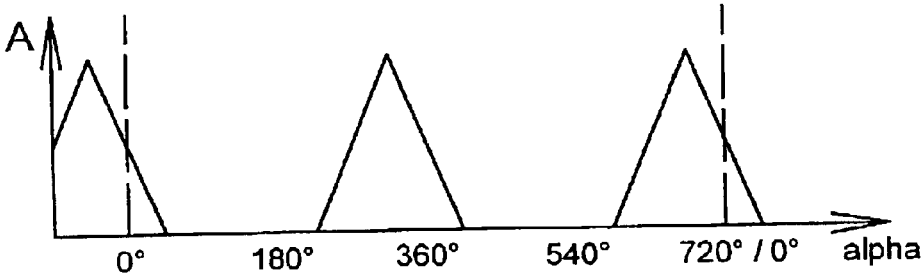
FIG. 8 is the pulse diagram at the second collecting point VIII of FIG. 6.

FIG. 8 shows the pulse diagram at the location VIII in front of the collecting point IX. It can be seen that the pulses of FIG. 8 are time-delayed as compared to the pulses of FIG. 3.

Figure 9:
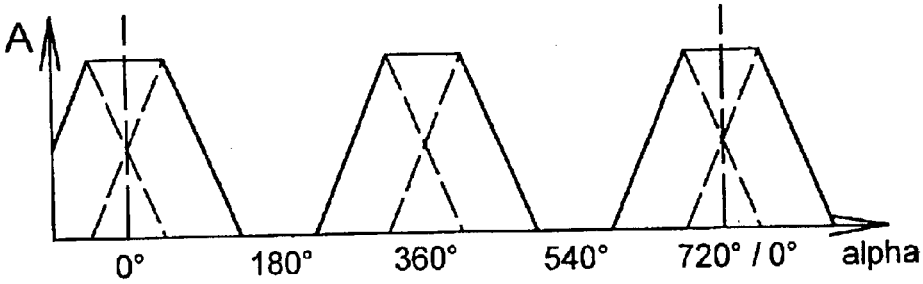
FIG. 9 is the pulse diagram at the third collecting point IX of FIG. 6.

FIG. 9 shows the pulse diagram resulting at the collecting point IX. This pulse diagram differs significantly from that of FIG. 4.

Figure 10:
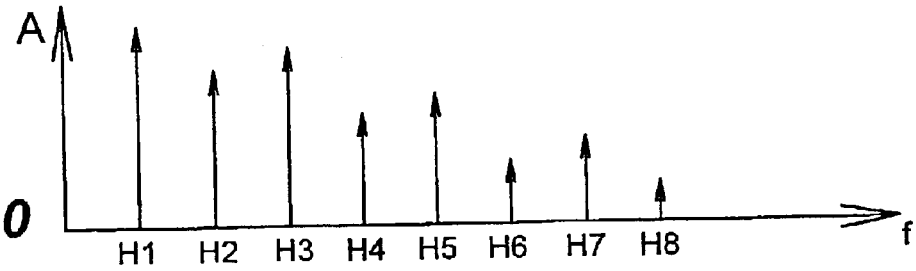
FIG. 10 is the frequency spectrum corresponding to the pulse diagram of FIG. 9.
Figure 11:
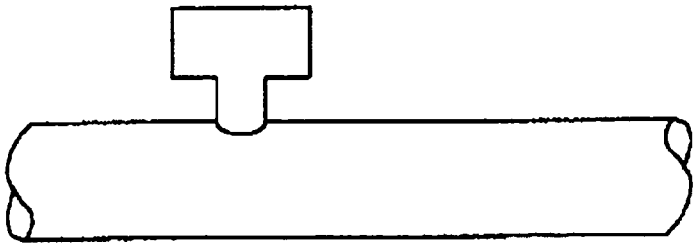
FIG. 11 schematically illustrates a resonator space coupled to the down-pipe.
Figure 12:
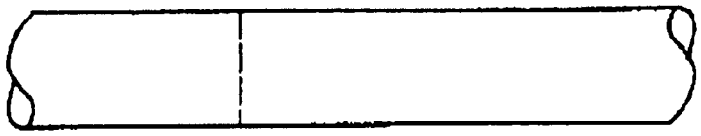
FIG. 12 schematically illustrates a screen mounted in the down-pipe.
Figure 13:
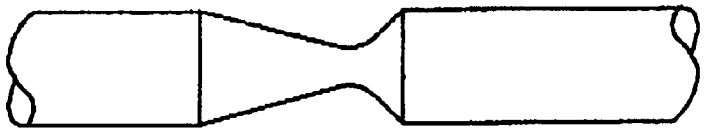
FIG. 13 schematically illustrates a nozzle mounted in the down-pipe.
Figure 14:
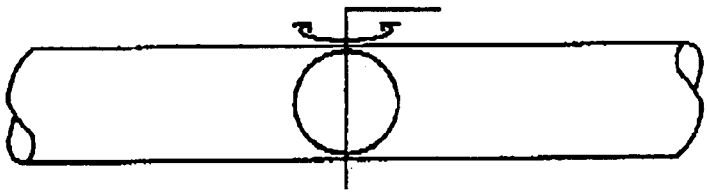
FIG. 14 schematically illustrates a valve mounted in the down-pipe.
Figure 15:
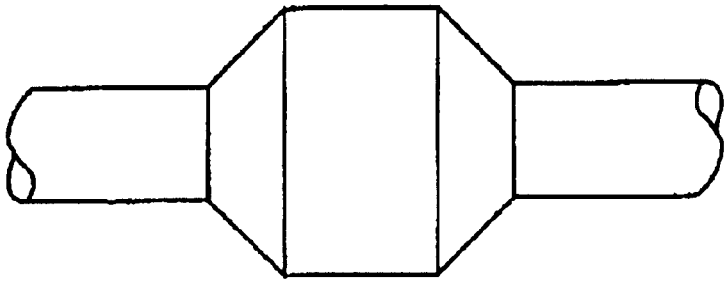
FIG. 15 schematically illustrates a flow-active body as a catalyst mounted in the down-pipe.

FIG. 10 shows the frequency spectrum corresponding to the pulse diagram of FIG. 9. It can be seen that now also the first harmonic H1, the third harmonic H3, etc., are present. It can further be seen that the amplitude of the second harmonic H2, the fourth harmonic H4, etc., is significantly lower because the sound energy contained therein has been transferred into the newly formed harmonics.

As mentioned above, it is also possible to produce the 1.5th, 2.5th, 3.5th, etc., harmonics if the length and/or cross-section of the manifold pipes 2, 3, 4, 5 are further varied.

While specific embodiments of the invention have been shown and described in detail to illustrate the inventive principles, it will be understood that the invention may be embodied otherwise without departing from such principles.

We claim:

1. A device for producing a sporty sounding roaring exhaust sound in four-cylinder engines, the device comprising:

a manifold with four manifold pipes, two of which pipes meet in one of two first collecting points; and two down-pipes starting at the first collecting points respectively and ending at a second collecting point, a first of the down-pipes having a cross-section wider than a second of the down-pipes, and the second down-pipe having a length greater than the first down-pipe so that exhaust gas pulses traveling along the first and second down-pipes respectively reach the second collecting point at uneven distances.

2. The device according to claim 1, wherein the manifold pipes are configured so that the exhaust gas pulses traveling the manifold pipes reach the first collecting points respectively at even distances.

3. The device according to claim 1, comprising a resonator space coupled to at least one of the down-pipes.

4. The device according to claim 1, comprising a flow-active body mounted in at least one of the down-pipes.

5. The device according to claim 4, comprising a screen mounted in at least one of the down-pipes.

6. The device according to claim 4, comprising a nozzle mounted in at least one of the down-pipes.

7. The device according to claim 4, comprising a valve mounted in at least one of the down-pipes.

8. The device according to claim 4, comprising a catalyst body mounted in at least one of the down-pipes.

* * * * *